US005097883A

United States Patent [19]

Robinson et al.

[11] Patent Number: 5,097,883

[45] Date of Patent: Mar. 24, 1992

[54] FOLDING SHUTTER SYSTEM

[75] Inventors: James W. Robinson, 15302 SW. 100 Ct., Miami, Fla. 33157; Jeffrey T. Robinson, 15900 Sedgewyck Cir. North, Davie, Fla. 33331; Andrew Bruno, 7913 Orleans St., Miramar, Fla. 33023

[73] Assignees: James W. Robinson, Miami; Jeffrey T. Robinson, Davie; Andrew Bruno, Miramar, all of Fla. ; part interest to each

[21] Appl. No.: 693,288

[22] Filed: Apr. 30, 1991

[51] Int. Cl.[5] ..... E05D 15/26

[52] U.S. Cl. ..... 160/183; 160/118; 160/199

[58] Field of Search ..... 160/199, 201, 183, 186, 160/187, 196.1, 206, 113, 118

[56] References Cited

U.S. PATENT DOCUMENTS

| | | | |
|---|---|---|---|
| 2,770,298 | 11/1956 | Hiatt | 160/183 X |
| 3,405,756 | 10/1968 | Harris | 160/183 X |
| 3,529,651 | 9/1970 | Bender | 160/183 |
| 3,670,797 | 6/1972 | Sassano | 160/183 X |
| 3,799,237 | 3/1974 | Proserpi | 160/199 |
| 4,386,645 | 6/1983 | Dever et al. | 160/183 |
| 4,497,357 | 2/1985 | Labelle | 160/183 X |
| 4,660,613 | 4/1987 | Dagenais | 160/183 X |
| 4,848,436 | 7/1989 | Dagenais | 160/199 |

*Primary Examiner*—David M. Purol
*Attorney, Agent, or Firm*—Staas & Halsey

[57] ABSTRACT

A novel folding storm shutter system includes an overhead header presenting a track and a pair of laterally spaced abutment surfaces. The system includes a plurality of trolley supported shutter members which are rotatable about a vertical axis. The system further includes a sill having a guide slot which is disposed beneath the track in alignment therewith. The sill also has a pair of laterally spaced abutment surfaces. An abutment contacting element is disposed at each corner of each shutter member so that when the shutter system is deployed the contact elements come into contact with the abutment surfaces to rigidify the structure. Trolley mechanisms are provided for supporting the trolley supported shutter members from a location midway between the edges of the shutter member so that the entire assembly is evenly balanced to facilitate maneuvering and deployment of the system.

25 Claims, 8 Drawing Sheets

FOLDING SHUTTER SYSTEM

BACKGROUND OF THE INVENTION

1. Field of the Invention

This invention relates to folding storm shutter systems and in particular to such systems which are suitable for resisting high wind loading.

2. The Prior Art Background

In areas such as coastal areas which are regularly subjected to storms which generate high winds, it is traditional to attempt to protect windows and other large expanses of glass by covering the same with shutter systems capable of withstanding large wind loads without substantial deflection and/or stress damage. Many coastal areas such as South Florida have enacted exacting building codes in an effort to regulate the design characteristic of storm shutter systems; however, present day structures are bulky, expensive, difficult to maneuver and often unattractive. Thus, the need for an inexpensive, sturdy, readily deployable, convenient to use, attractive shutter system, which requires a minimum of stacking space, has continued.

SUMMARY OF THE INVENTION

The shortcomings of prior art storm shutter systems are addressed and alleviated by the present invention which provides a novel folding shutter system that is attractive, relatively inexpensive, sturdy, stackable in a small space, readily maneuverable and strong enough to withstand heavy wind loads and otherwise comply with the exacting performance requirements of building codes such as the South Florida 1988 Building Code. In accordance with the invention, the novel folding storm shutter system comprises an elongated header which includes a centrally disposed, longitudinally extending track and a pair of longitudinally extending, outwardly facing abutment surfaces disposed on respective opposite sides of said track. The abutment surfaces are spaced laterally apart a predetermined distance.

The system further includes a trolley mechanism mounted on said track for movement in either direction therealong and at least one elongated, generally rectangularly shaped trolley supported shutter member having a pair of longitudinally spaced opposite ends and a pair of laterally spaced opposed edge portions. The trolley mechanism is connected to one of the ends of the trolley supported shutter member at a location between said edge portions such that the trolley supported shutter member hangs from the trolley mechanism and moves therewith as the trolley mechanism moves along the track. The connection between the trolley and the shutter is such that the trolley supported shutter member is free to rotate about an axis which is disposed between the edge portions and extends longitudinally of the trolley supported shutter member.

Also included in the system is a respective abutment surface contacting element located at each edge portion of said one end of the shutter member. The distance between the edge portions is greater than the predetermined distance between the abutment surfaces so that each of said elements is positioned outwardly of its corresponding, respective abutment surface. The elements are positioned so that upon deployment of the shutter system the elements swing into contact with the respective corresponding abutment surfaces as the trolley supported shutter member rotates about said axis. This contact between the abutment contacting elements and the abutment surface assists in rigidifying the system and provides the same with the ability to withstand very great wind loading.

Preferably the system includes an elongated sill having a centrally disposed, longitudinally extending guide slot therein. The slot is disposed beneath the track in spaced relationship thereto and in general alignment therewith. The trolley supported shutter member is disposed so as to extend between the track and the guide slot, and the system further includes a guide pin structure which is attached to the other end of said shutter member at said axis and extends into the slot. Even more preferably, the sill is provided with a pair of longitudinally extending, outwardly facing abutment surfaces disposed on respective opposite sides of said slot. The abutment surfaces of the sill are spaced laterally apart the same distance as the abutment surfaces of the header and the system includes respective abutment surface contacting elements located at each edge portion of the other end of the trolley supported shutter member such that each of these elements at said other end is also positioned outwardly of its corresponding respective abutment surface of the sill. These elements at the other end of the shutter member are also positioned so that upon deployment of the system the elements swing into contact their respective corresponding abutment surfaces of the sill as the shutter member rotates about said axis so as to further rigidify the structure.

In another sense, the invention provides a shutter system which includes a plurality of elongated, generally rectangularly shaped shutter members. Each shutter member has a pair of longitudinally spaced opposite ends and a pair of laterally spaced edge portions. The shutter members are arranged, when deployed, in a side-by-side, zig-zag array which extends longitudinally of said header. The edge portions of adjacent shutter members are interconnected so as to permit adjacent shutter members to articulate relative to one another about a vertical axis which extends along the interconnected edge portions. At least one of said shutter members of the array is a trolley supported shutter member as described above.

In a preferred sense, the invention provides a system which includes a plurality of trolley mechanisms and a trolley supported shutter member for each of the trolley mechanisms. The trolley supported shutter members should each have an abutment contacting element at each edge portion at each end thereof to provide maximum rigidity and sturdiness to the overall structure.

For attractiveness and overall functional utility, the shutter system may include one or more vent shutter members having a vent opening which may be covered with a transparent panel. Ideally the vent shutter members may be provided with a pair of side-by-side vent openings.

In a much preferred form of the invention, the system includes a plurality of vent shutter members and a plurality of trolley supported members and the same are arranged in a zig-zag array formed by alternating vent shutter members and trolley supported shutter members.

The folding shutter system may include at least two zig-zag arrays, with each array having a trolley supported centermate structure at one end thereof. The centermate structures may be configured so as to mate with one another upon deployment and closing of the shutter system.

One of the centermate structures may include a male fitting and the other may include a female fitting, and each fitting may include a flat striker surface. The surfaces come into close proximity upon closing of the system and provide an ideal environment for the installation of a cylinder operated dead lock locking mechanism. Preferably, the centermate structures are elongated and coextensive in length with the shutter members, and each includes an insertable longitudinally extending strike bar presenting said flat striker surface. The centermate structures also may include a generally cylindrical, longitudinally extending slide bolt receiving channel.

In a preferred form of the invention, the header, the sill, the shutter members, the centermate structures and the strike bars may each be formed by extrusion from a corrosion resistant material such as aluminum.

DETAILED DESCRIPTION OF THE PREFERRED EMBODIMENTS

Figure 1:
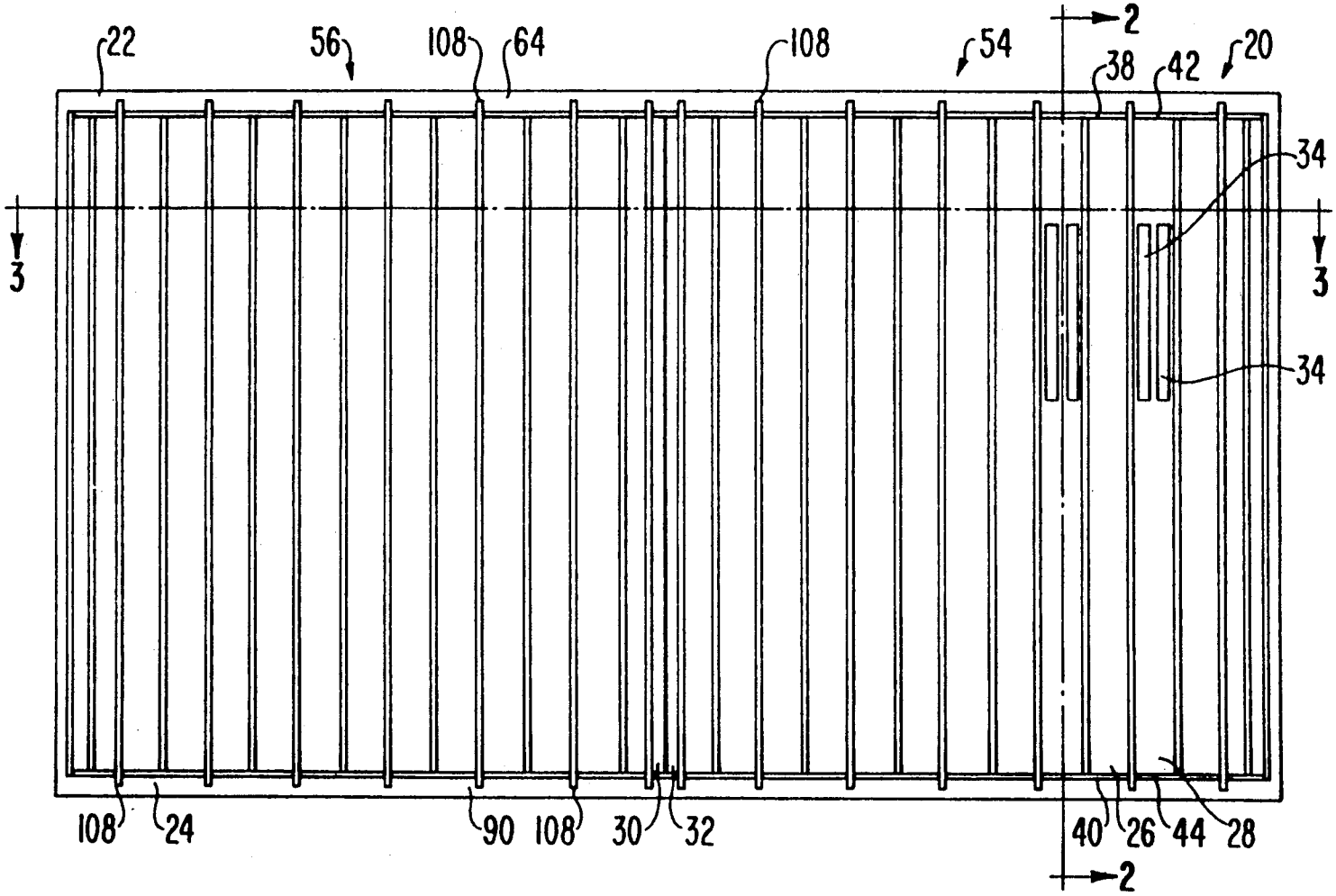
FIG. 1 is an elevational view of a deployed shutter system which embodies the concepts and principles of the present invention.

A folding shutter system which embodies the concepts and principles of the present invention is illustrated in FIG. 1 where the system is broadly identified by the reference numeral 20. The system includes an elongated header 22, an elongated sill 24 and a plurality of elongated, generally rectangularly shaped shutter members 26 and 28. The system also includes a female centermate structure 30 and a male centermate structure 32, each of which is elongated and coextensive in length with the shutter members 26 and 28. The shutter members 28 may preferably each have a pair of side-by-side vent openings 34 therein, and the shutter members 26 are supported by trolley mechanisms 36 as can best be seen in FIG. 2.

Each of the shutter members 26 has an upper end 38 and a lower end 40 which are thus spaced longitudinally of shutter member 26 at opposite ends thereof. Likewise, each shutter member 28 has an upper end 42 and a lower end 44 which are spaced longitudinally of shutter member 28 and are therefore disposed at the opposite ends of the latter.

Figure 4:
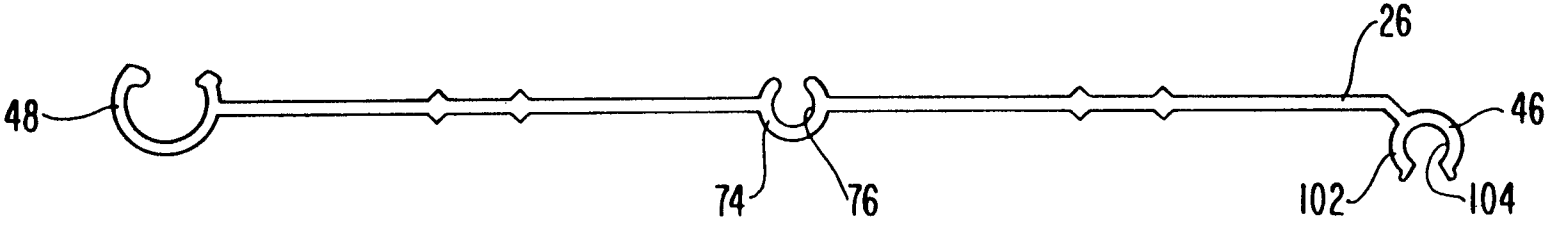
FIG. 4 is an end view of an extruded trolley supported shutter member used in connection with the system of FIG. 1.

Each shutter member 26 also has a pair of laterally spaced edge portions 46 and 48, and each shutter member 28 has a similar pair of laterally spaced edge portions 50 and 52. These edge portions may best be seen in FIGS. 4 and 5 which are end views of the respective shutter members 26 and 28.

Figure 3:
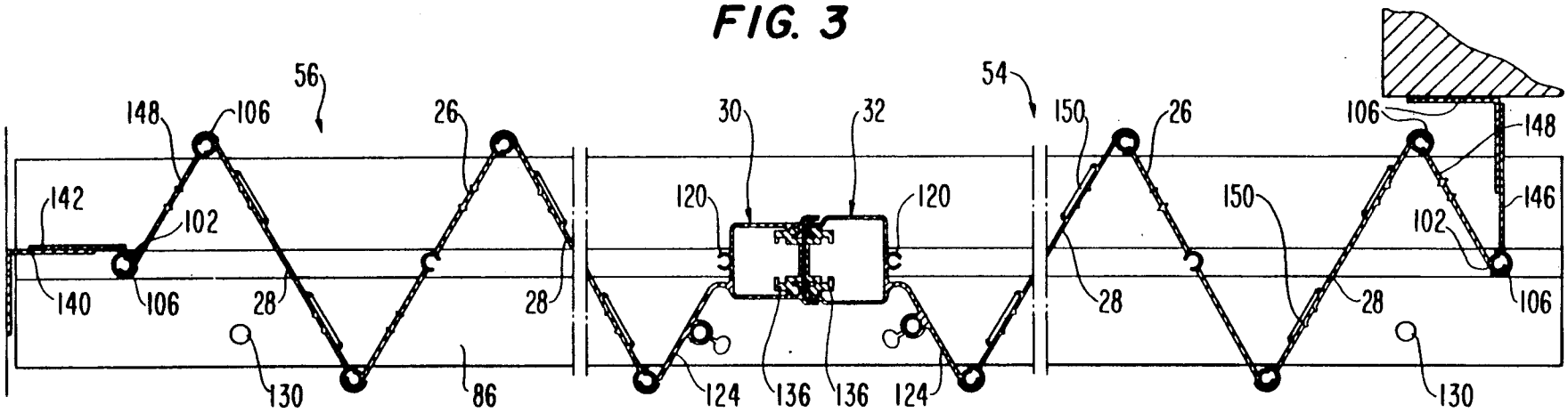
FIG. 3 is an enlarged cross-sectional view taken along the line 3—3 of FIG. 1.

With reference to FIGS. 1 and 3, it can be seen that in the preferred form of the invention, the shutter system 20 includes a pair of arrays 54 and 56 of shutters 26 and 28 and when the shutter system is deployed, as is illustrated in FIGS. 1 and 3, the shutter members 26 and 28 are arranged in a side-by-side, zig-zag configuration which extends longitudinally of header 22 and sill 24. It can also be seen that each of the arrays 54 and 56 is made up of alternating vent shutter members 28 and trolley supported shutter members 26. Moreover, it can be seen that each of the arrays 54 and 56 includes at least one trolley supported shutter member 26.

Figure 2:
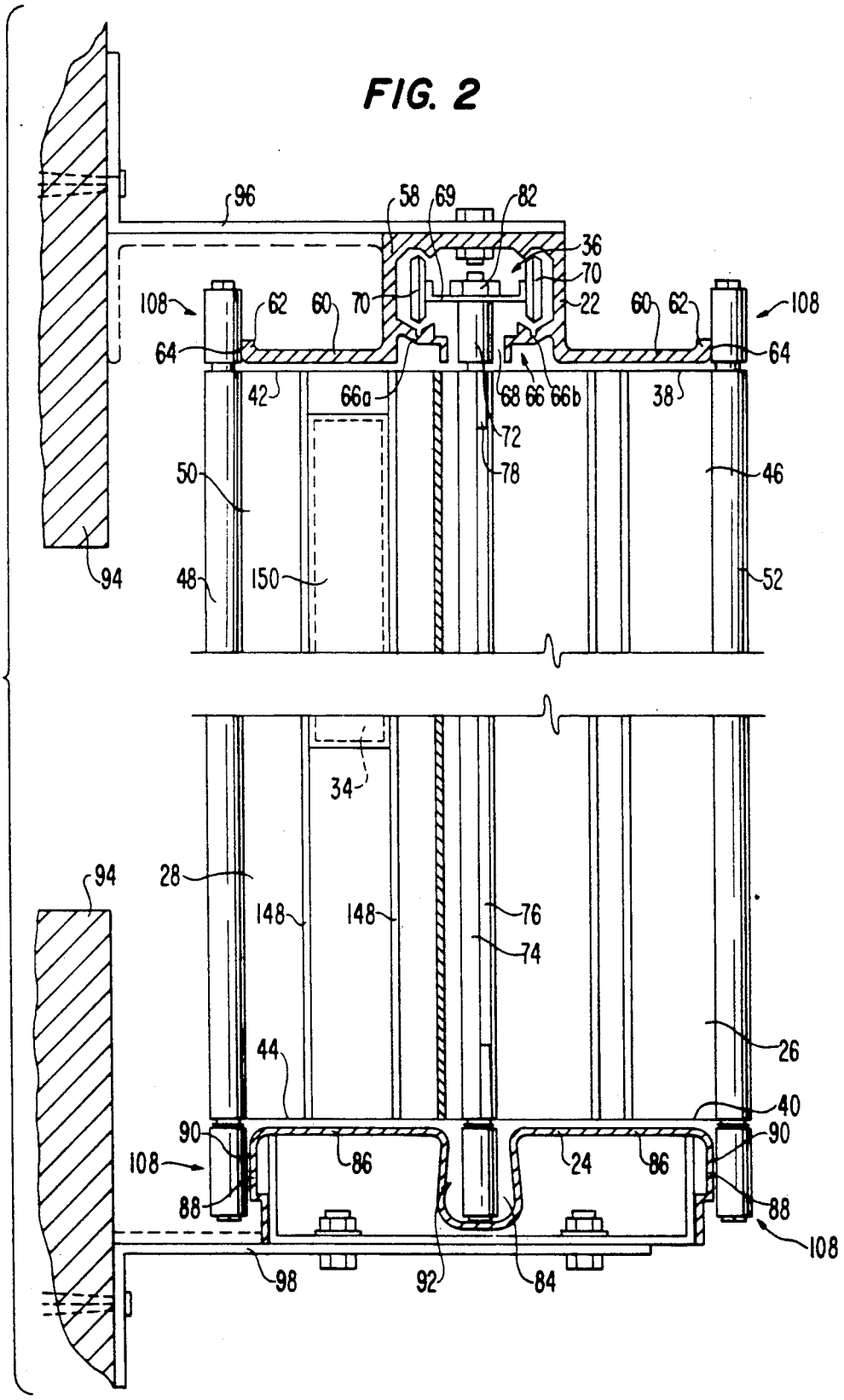
FIG. 2 is an enlarged cross-sectional view taken along the line 2—2 of FIG. 1.

The header 22 and the sill 24 are well illustrated in FIG. 2. Header 22 includes a central header box 58 and a pair of laterally extending wings 60. Upturned segments 62 at the respective outboard ends of wings 60 present outwardly facing abutment surfaces 64 which extend longitudinally of header 22 for the entire length thereof. Constructed within header box 58 is a centrally disposed track 66 which extends longitudinally of header 22 for its entire length. Track 66 is made up of a pair of spaced portions **66*a* and 66*b*, and the header is also configured to present a gap 68 which extends the entire length of header 22 between spaced portions 66*a* and 66*b* of the track 66**.

Again with reference to FIG. 2, it can be seen that the trolley mechanism 36 is disposed within header box 58. Mechanism 36 includes a central C-shaped carriage portion 69 and a pair of wheels 70 which are configured to ride in track portions **66*a* and 66*b*. Although the wheels 70 are illustrated as being slightly above track portions 66*a* and 66*b*, in operation the wheels 70 will actually be in contact with the track portions 66*a* and 66*b* so that the entire trolley mechanism 36 is able to move readily in either direction along track 66. And although only a single trolley mechanism 36 is illustrated in FIG. 2, it will be appreciated by those skilled in the art that a trolley mechanism 36 is provided for each of the trolley supported shutter members 26. In this regard, in the preferred embodiment of the invention illustrated in the drawings, the vent shutter members 28** are not trolley supported, but are supported primarily by the interconnection of the edge portions of adjacent shutter members.

Trolley mechanism 36 is connected to the top end 38 of the trolley supported shutter member 26 at a location which is approximately at the mid-point between opposed edge portions 46 and 48. The connection is such that the trolley supported shutter member 26 hangs from trolley mechanism 36 so as to move therewith as the trolley mechanism 36 moves along track 66. Moreover, the connection between trolley mechanism 36 and shutter member 26 is such that the latter is free to rotate about an axis of rotation 72 which extends downwardly from trolley mechanism 36 and longitudinally of shutter member 26. To facilitate such rotation, shutter member 26 is provided with a generally centrally located center fitting 74 which presents a pin receiving channel 76 therein. (See FIG. 4). A pin 78 is received in pin receiving channel 76 and is secured therein by screw threads or the like and projects upwardly from the upper end 38 of shutter member 26. A nylon bushing is disposed between the upper end 38 of shutter member 26 and the carriage portion 69 of trolley mechanism 36 as shown. The upper end of pin 78 projects through carriage portion 69 and is secured by a nut 82 so that pin 78 and therefore shutter member 26 simply hang from carriage portion 69 and are free to rotate about axis of rotation 72. By hanging the shutter members 26 from the mid-point between edge portions 46 and 48, the entire weight of the system is essential balanced beneath track, 66 so as to facilitate maneuvering and deployment of the system.

With reference once again to FIG. 2, sill 24 includes a centrally disposed guide slot 84 which extends longitudinally for the entire length of sill 24. Guide slot 84 is disposed beneath track 66 in general alignment therewith. Sill 24 also includes a pair of laterally extending shelf portions 86. A down turned segment 88 at the outboard end of each shelf portion 86 presents an outwardly facing abutment surface 90 which extends longitudinally of sill 24 for the entire length thereof.

A guide pin structure 92 is attached to the bottom end 40 of shutter member 26 at axis 72 and extends into slot 84 as illustrated in FIG. 2.

The folding shutter system 20 may be mounted as illustrated in FIG. 2 on a wall 94. For this purpose an angle 96 may be used to support header 22 using a nut and bolt arrangement as illustrated. Angle 96 may be attached to wall 94 by screws or otherwise using fastening technology which is well known to those of ordinary skill in the art. Another angle 98 may be used at a lower end of the system 20 to support a sill adaptor 100 for supporting sill 24 as shown. Adaptor 100 may be attached to angle 98 by nut and bolt means as illustrated and again angle 98 may be connected to wall 94 using screws or other known fastening means.

When shutter member 26 is hung from trolley mechanism 36 as illustrated in FIG. 2, shutter member 26 extends between track 66 and guide slot 84 and is free to rotate about the axis 72 which is disposed at approximately the mid-point between edge portions 46 and 48 of shutter member 26.

Figure 10:
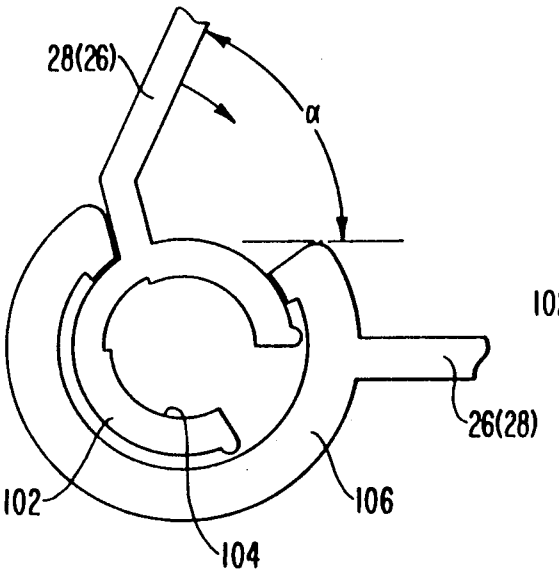
FIG. 10 is an enlarged, fragmentary end view illustrating the interrelationships and operation of the shutter member edge joint portions which permit adjacent shutter members to articulate relative to one another.

The manner in which adjacent shutter members are interconnected is illustrated in FIGS. 3 and 10. In this regard, the adjacent edge portions are interconnected so as to permit adjacent shutter members to articulate relative to one another about an axis which extends vertically along the adjacent edge portions. As can be seen from FIGS. 4 and 5, edge portion 50 of shutter member 28 and edge portion 46 of shutter member 26 each is in the form of a male end fitting 102 which includes a pin or screw receiving channel 104. Moreover, the edge portion 48 of shutter member 26 and the edge portion 52 of shutter member 28 each is in the form of a female end fitting 106 which is adapted for receiving a male end fitting 102 therein as illustrated in FIG. 10. The configuration of end fittings 102 and 106 and the interrelationships therebetween to facilitate relative articulation of adjacent shutter members is illustrated in FIG. 10 where it can be seen that the adjacent shutter members are capable of relative articulation through an angle $\alpha$.

Figure 12:
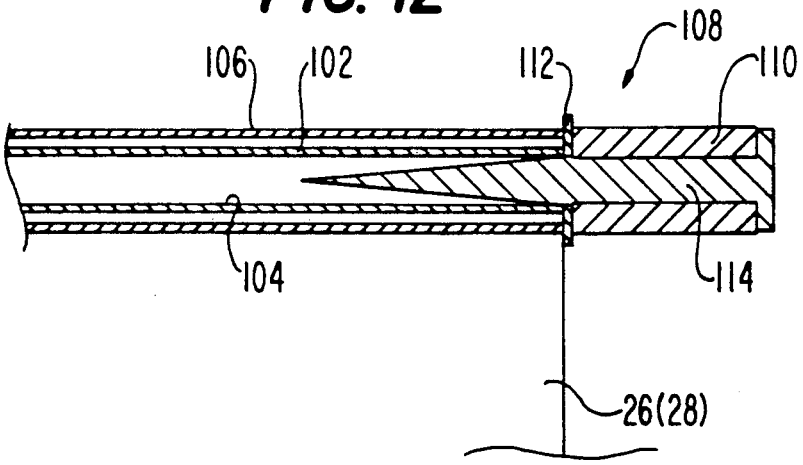
FIG. 12 is a cross-sectional, fragmentary view illustrating the details of the construction of the abutment contacting elements.

The channel 104 at each interconnection between adjacent shutter panels is provided with an abutment surface contacting element 108 at the upper and lower ends of each shutter member 26, 28. The details of the abutment contacting elements 108 are best illustrated in FIG. 12 where it can be seen that the element 108 includes a nylon bushing 110, a washer 112 and a screw 114. The threads of the screw 114 bite into the internal surfaces of channel 104 to secure element 108 in place. Guide pin structure 92 may be constructed identically to the elements 108.

Figure 13:
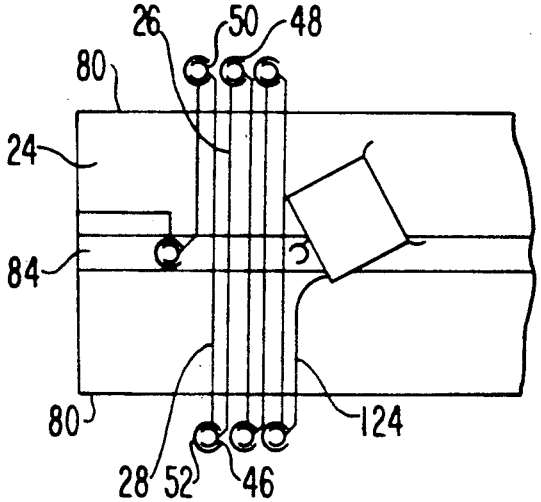
FIG. 13 is a schematic view illustrating one side of the system in an undeployed, stacked condition.

The abutment surfaces 64 are disposed on respective opposite sides of track 66 and the same are spaced apart laterally a predetermined distance which is less than the width of the individual shutter members 26, 28. Moreover, the abutment surfaces 90 on sill 24 are disposed on respective opposite sides of guide slot 84, and these surfaces are spaced apart laterally approximately the same distance as the distance between surfaces 64. The distance between surfaces 64 and the distance between surfaces 90 is predetermined so as to provide an angle $\alpha$ (see FIG. 10) which is approximately 60° when the shutter system is fully deployed. In this same regard, the edge portions 46 and 48 of shutter members 26 and the edge portions 50 and 52 of shutter member 28 are laterally spaced such that the distance between the edge portions of each shutter member is greater than the distances between abutment surfaces 64 of header 22 and between abutment surfaces 90 of sill 24. This can be seen in FIG. 13 which provides a schematic view of the shutter system in its stacked or open or undeployed condition.

Thus, when the shutter system is in its stacked condition, edge portions 50 and 52 of shutter member 28 and edge portions 46 and 48 of shutter member 26 are located outwardly away from abutment surfaces 64, 90. On the other hand, when the shutter system is moved into its deployed condition as illustrated in FIG. 3, the shutter members 26 and 28 rotate relative to the header 22 and the sill 24 so that the abutment surface contacting elements come into contact with corresponding abutment surfaces 64, 90 as each shutter member 26, 28 rotates into its fully deployed position. It should also be noted that in the illustrated embodiment, the abutment surface contacting elements 108 located at the upper and lower ends of each shutter member are always disposed outwardly of the corresponding respective abutment surfaces so that the surfaces will be contacted by the elements when the folding shutter system is deployed. This contact between the elements 108 carried by the shutter members 26 and 28 and the abutment surfaces 64 and 80 on both sides of the header 22 and of the sill 24 provides great strength and wind resistance to the deployed system.

With reference to FIG. 3 it can be seen that the array 56 is provided with a trolley supported centermate structure 30 and array 54 is provided with a trolley supported centermate structure 32. For this purpose each structure 30, 32 includes a center fitting 120 which presents a pin or screw receiving channel 122. The upper end of each channel 122 is used to connect the centermate structure 30, 32 to a trolley mechanism 36 in exactly the same way that the shutter members 26 are connected to a trolley mechanism 36 using center channel 74. Moreover, a guide pin structure which is identical with the guide pin structure 92 is provided at the lower end of each channel 122 to guide the movement of each respective centermate structure 30, 32 along sill 24.

Each structure 30, 32 is also provided with an extension arm 124 which has a male end fitting at its outer end that is identical with the male end fittings of shutter members 26 and 28. As can be seen in FIG. 3, the male end fitting 102 of each centermate structure 30, 32 is received in the female end fitting 106 of an adjacent shutter member 28.

Each centermate structure 30, 32 also includes a generally cylindrical fitting 126 which presents a generally cylindrical channel 128 for accommodating a slide bolt. Slide bolt receiving holes 130 may be provided in the shelf 86 of sill 24 for receiving the slide bolt to lock the system in either a deployed or undeployed condition.

Figure 7:
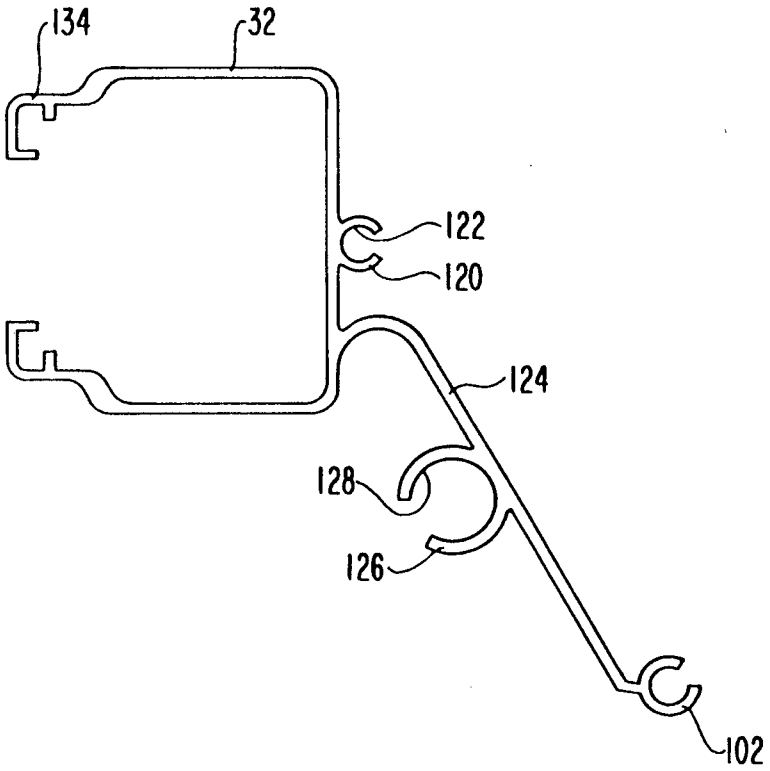
FIG. 7 is an end view of an extruded male center mate structure used in connection with the system of FIG. 1.
Figure 6:
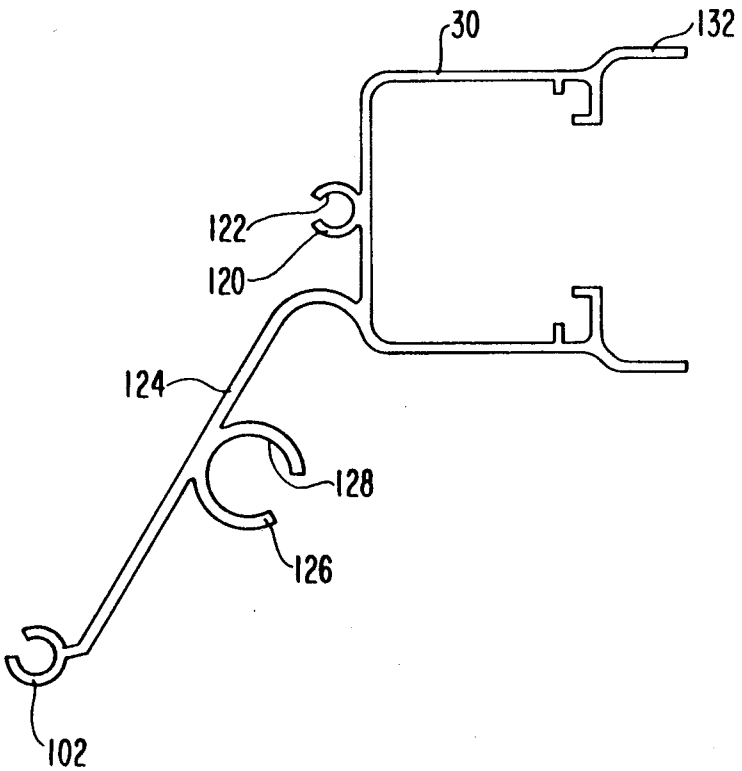
FIG. 6 is an end view of an extruded female centermate structure used in connection with the system of FIG. 1.

As illustrated in FIG. 3 and in FIG. 6, the centermate structure 30 has a female fitting 132 at its right hand side (FIG. 6) while centermate structure 32 has a male fitting 134 at its left hand side (FIG. 7). The fittings 132 and 134 mate as the folding shutter system 20 becomes fully deployed into its closed condition as illustrated in FIG. 3.

Figure 9:
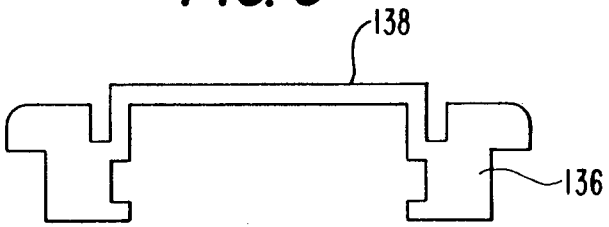
FIG. 9 is an end view of a strike bar which may be used in the centermate structures of FIGS. 6 and 7.

Each of the structures 30, 32 is provided with a configuration for receiving an insertable, longitudinally extending strike bar 136 which is best illustrated in FIG. 9. The strike bar 136 is illustrated in its operational position in centermate structures 30, 32 in FIG. 3. Each strike bar 136 presents a flat striker surface 138 and the flat surfaces 138 of the strike bars 136 come into close proximity as fittings 132 and 134 mate when the shutter system 20 is fully deployed as shown in FIG. 3. These flat striker surfaces 138 provide an appropriate environment to facilitate the use of a hook bolt deadlock for locking the shutter system in its fully closed position. Suitable deadlocks useful in connection with the invention are known to those of ordinary skill in the art and are manufactured by Adams Rite Manufacturing Company under the designation MS1850S-050.

FIG. 3 illustrates alternative ways for mounting the shutter system 20 of the present invention. At the left hand side of FIG. 3, an angle 140 is used to support an L-shaped end mount 142 provided with a female fitting which is identical with the female end fitting 106. Thus, the system is mounted on a wall which extends perpendicularly to the shutter system. At the right end of FIG. 3, an angle 144 is used to support a flat end mount 146 which also has a female end fitting that is identical with the female fitting 106. Thus, the shutter system is suspended from a wall which is parallel to the system. In each case, a half blade shutter member 148 having a male end fitting 102 at one end and a female end fitting 106 at the other end is utilized to interconnect the folding shutter system with the end mounting structures as shown.

Figure 5:
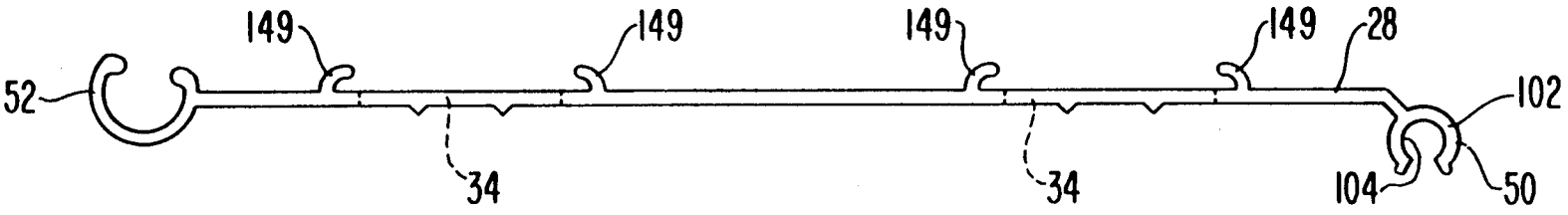
FIG. 5 is an end view of an extruded vent shutter member used in connection with the system of FIG. 1.

The vent shutter members 28 may be provided with L-shaped brackets 149 as illustrated in FIG. 5. These brackets 149 are configured for receiving transparent panels 150 and holding the same in place over openings 34. Such panels may preferably be constructed of a polycarbonate material such as Lexan.

One of the major economical advantages of the folding shutter system as described in this application is that most of the components including the header 22, the sill 24, the shutter members 26, the shutter members 28, the female centermate structure 30, the male centermate structure 32, the sill adaptor 100, the various mounting angles, the half blade members 148, the strike bar 136, and the end mounts 142 and 146 are susceptible of being extruded since the cross-sectional configuration of each of these elements is constant from on end to the other.

Figure 8:
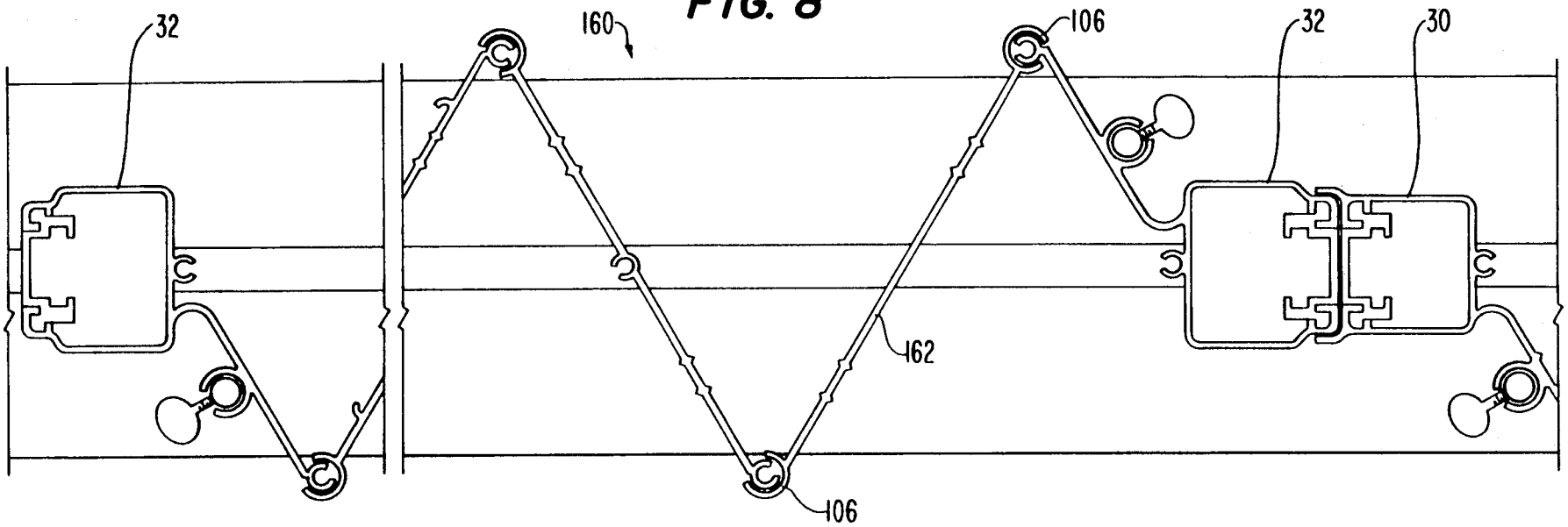
FIG. 8 is a cross-sectional view similar to FIG. 2 for illustrating an alternative array of components for the shutter system.

The overall flexibility of the system is illustrated in FIG. 8 which illustrates an embodiment whereby the folding shutter system may include more than two arrays of side-by-side, zig-zag arrangements of the shutter members 26 and 28. Thus, the FIG. 8 embodiment includes an array 160 which includes a shutter member 162 having a female fitting 106 at each end thereof. This enables the use of a male centermate structure 32 at each end of the array 160. Manifestly, other arrangements of the various components would readily be determinable from the foregoing description by one of ordinary skill in the art.

In addition to the foregoing, the vertical height of the system is readily altered simply by changing the length of the shutter members and centermates, and the horizontal span is readily altered by using more or less shutter members and changing the lengths of the header and the sill.

Figure 11:
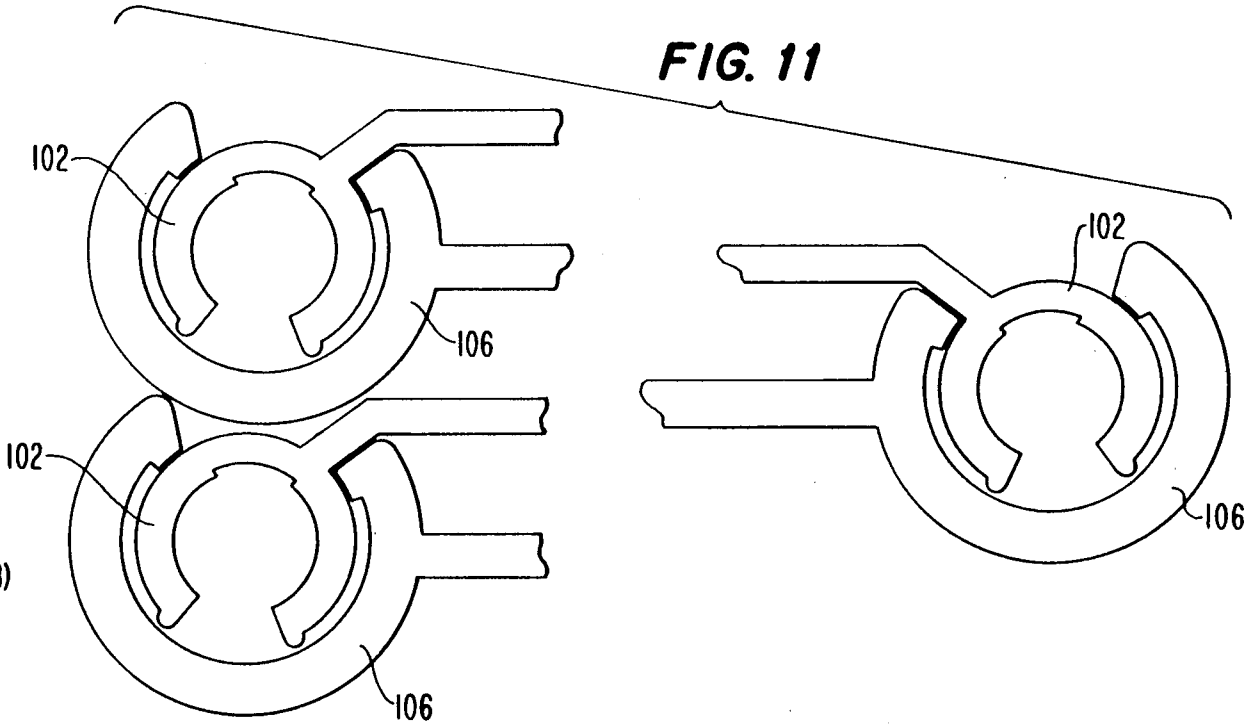
FIG. 11 is an enlarged, fragmentary end view of the interconnected edge portions of the shutter members when the latter are in their undeployed, stacked condition.

As mentioned above, FIG. 13 schematically illustrates the folding shutter system 20 in its undeployed, stacked condition. The relative positioning of the female end fittings 106 and the male end fittings 102 during such stacking is illustrated in FIG. 11 which also illustrates the manner in which the end fittings snugly nest to minimize the space requirements during stacking. This stacking is further facilitated by alternating the shutter members 26 and 28 as shown in FIG. 3 so that the center fitting 74 is present only on every other shutter member of the array.

The various extrudable components may preferably be formed from an aluminum alloy such a 6063-T5 for the shutter members, the centermate structures and the sill. The header and the locking style may preferably be extruded from 6063-T6 aluminum alloy. Fasteners may preferably be formed from 2024-T4 aluminum or galvanized or stainless steel with a 33 KSI minimum yield point. Other fasteners are well known to those of ordinary skill in the art. For a particularly useful commercial design, the shutter members 26 and 28 may preferably be about 7 inches in width and typically may have a thickness of about 0.07 inches. The channels 76, 104 and 122 may preferably have an inside diameter of about 0.224 inches so as to accommodate a ¼ inch screw thread. The centermate structures may have a dimension of approximately 2 inches on each side and the channels 128 may have an inside diameter sufficient for accommodating a ½ inch aluminum slide bolt.

We claim:

1. A folding shutter system comprising:

an elongated header including a centrally disposed, longitudinally extending track and a pair of longitudinally extending, outwardly facing abutment surfaces disposed on respective opposite sides of said track, said abutment surfaces being spaced laterally apart a predetermined distance;

a trolley mechanism mounted on said track for movement in either direction therealong;

an elongated, generally rectangularly shaped trolley supported shutter member having a pair of longitudinally spaced opposite ends and a pair of laterally spaced opposed edge portions, said trolley mechanism being connected to one of said ends of the trolley supported shutter member at a location between said edge portions such that the trolley supported shutter member hangs from the trolley mechanism and moves therewith as the trolley mechanism moves along the track, said connection being such that the trolley supported shutter member is permitted to rotate about an axis which is disposed between the edge portions and extends longitudinally of the trolley supported shutter member;

a respective abutment surface contacting element located at said one end of said shutter member at each edge portion thereof, the distance between said edge portions being greater than said predetermined distance such that each of said elements is positioned outwardly of its corresponding, respective abutment surface, said elements being positioned so that upon deployment of the system the elements swing into contact with their respective corresponding abutment surfaces as the trolley supported shutter member rotates about said axis.

2. A folding shutter system as set forth in claim 1, wherein is included an elongated sill having a centrally disposed, longitudinally extending guide slot therein, said slot being disposed beneath said track in spaced relationship thereto and in general alignment therewith, said trolley supported shutter member extending between said track and said guide slot, said system further including a guide pin structure attached to the other end of said shutter member at said axis and extending into said slot.

3. A folding shutter system as set forth in claim 2, wherein said sill has a pair of longitudinally extending, outwardly facing abutment surfaces disposed on respective opposite sides of said slot, said abutment surfaces of the sill being spaced laterally apart said predetermined distance, there being a respective abutment surface contacting element located at said other end of the trolley supported shutter member at each edge portion thereof such that each of said elements at said other end is positioned outwardly of its corresponding respective abutment surface of the sill, said elements at said other end of the shutter member being positioned for contacting said respective corresponding abutment surfaces of the sill as the shutter member rotates about said axis.

4. A folding shutter system as set forth in claim 1, wherein is included a plurality of elongated, generally rectangularly shaped shutter members, each having a pair of longitudinally spaced opposite ends and a pair of laterally spaced edge portions, said shutter members being arranged, when deployed, in a side-by-side, zig-zag array which extends longitudinally of said header, the edge portions of adjacent shutter members being interconnected so as to permit said adjacent shutter members to articulate relative to one another about an axis which extends along said interconnected edge portions, at least one of said shutter members of said array being said trolley supported shutter member.

5. A folding shutter system as set forth in claim 4, wherein is included a plurality of said trolley mechanisms and said plurality of shutter members includes a said trolley supported shutter member for each of said trolley mechanisms, said trolley supported shutter members each having a said abutment contacting element at each said edge portion thereof.

6. A folding shutter system as set forth in claim 4, wherein at least one of said shutter members is a vent shutter member provided with a vent opening.

7. A folding shutter system as set forth in claim 3, wherein is included a plurality of elongated, generally rectangularly shaped shutter members, each having a pair of longitudinally spaced opposite ends and a pair of laterally spaced edge portions, said shutter members being arranged when deployed in a side-by-side, zig-zag array which extends longitudinally of said header, the edge portions of adjacent shutter members being interconnected so as to permit said adjacent shutter members to articulate relative to one another about an axis which extends along said interconnected edge portions, at least one of said shutter members of said array being said trolley supported shutter member.

8. A folding shutter system as set forth in claim 7, wherein is included a plurality of said trolley mechanisms and said plurality of shutter members includes a said trolley supported shutter member for each of said trolley mechanisms, said trolley supported shutter members each having a said abutment contacting element at each end of each said edge portion thereof.

9. A folding shutter system as set forth in claim 8, wherein at least one of said shutter members is a vent shutter member provided with a vent opening.

10. A folding shutter system as set forth in claim 9, wherein said vent shutter member is not a trolley supported shutter member.

11. A folding shutter system as set forth in claim 10, wherein said zig-zag array includes alternating vent shutter members and trolley supported shutters members.

12. A folding shutter system as set forth in claim 6, wherein said vent shutter member is provided with a pair of side-by-side vent openings.

13. A folding shutter system as set forth in claim 4, wherein said shutter system includes at least two of said arrays, each array having a trolley supported centermate structure at one end thereof, said centermate structures being configured to mate with one another upon closing of said shutter system.

14. A folding shutter system as set forth in claim 13, wherein one of said structures includes a male fitting and the other includes a female fitting, each said fitting including a flat striker surface, said surfaces coming into close proximity upon closing of the system.

15. A folding shutter system as set forth in claim 14, wherein each of said centermate structures is elongated and coextensive in length with said shutter members, said structures each including an insertable, longitudinally extending strike bar presenting said flat striker surface.

16. A folding shutter system as set forth in claim 13, wherein each of said centermate structures is elongated and coextensive in length with said shutter members, said structures each including a generally cylindrical, longitudinally extending slide bolt receiving channel.

17. A folding shutter system as set forth in claim 3, wherein said header, said sill, and said shutter member are formed from aluminum.

18. A folding shutter system as set forth in claim 3, wherein said header, said sill, and said shutter member are formed by extrusion.

19. A folding shutter system as set forth in claim 18, wherein said header, said sill, and said shutter member are formed from aluminum.

20. A folding shutter system as set forth in claim 7, wherein said header, said sill, and said shutter members are formed from aluminum.

21. A folding shutter system a set forth in claim 7, wherein said header, said sill, and said shutter members are formed by extrusion.

22. A folding shutter system as set forth in claim 20, wherein said header, said sill, and said shutter members are formed by extrusion.

23. A folding shutter system as set forth in claim 15, wherein said header, said sill, said centermate structures, said strike bars, and said shutter members are formed from aluminum.

24. A folding shutter system as set forth in claim 15, wherein said header, said sill, said centermate structures, said strike bars, and said shutter members are formed by extrusion.

25. A folding shutter system as set forth in claim 23, wherein said header, said sill, said centermate structures, said strike bars, and said shutter members are formed by extrusion.

* * * * *